United States Patent [19]

Cook et al.

[11] Patent Number: 4,909,211

[45] Date of Patent: Mar. 20, 1990

[54] BARREL-TYPE THROTTLE VALVE FOR ENGINE AIR INTAKE

[75] Inventors: Valerie G. C. Cook, Clearwater, Canada; Robert A. Schmidt, Sandusky, Mich.

[73] Assignee: Walbro Corporation, Cass City, Mich.

[21] Appl. No.: 352,969

[22] Filed: May 17, 1989

[51] Int. Cl.[4] ..... F02D 9/16

[52] U.S. Cl. ..... 123/337; 137/599.2; 137/601

[58] Field of Search ..... 123/337, 336; 137/625.3, 625.31, 625.32, 599.2, 601; 251/208, 209

[56] References Cited

U.S. PATENT DOCUMENTS

| | | | |
|---|---|---|---|
| 3,208,719 | 9/1965 | Hulsey | 137/625.32 |
| 4,759,326 | 7/1988 | Uthoff et al. | 123/337 |
| 4,774,984 | 10/1988 | Peters | 137/625.32 |
| 4,779,590 | 10/1988 | Uthoff | 123/337 |

FOREIGN PATENT DOCUMENTS

| | | | |
|---|---|---|---|
| 1550568 | 10/1969 | Fed. Rep. of Germany | 137/625.32 |

*Primary Examiner*—Tony M. Argenbright
*Assistant Examiner*—Robert E. Mates
*Attorney, Agent, or Firm*—Barnes, Kisselle, Raisch, Choate, Whittemore & Hulbert

[57] ABSTRACT

A throttle valve arrangement for an engine air intake includes an engine intake air passage having a longitudinal direction of air flow. A cylindrical bore extends laterally across the passage and has diametrically opposed openings longitudinally aligned with the passage. A cylindrical valve barrel or element is journalled for rotation within the bore and has an aperture extending diametrically therethrough for variably interconnecting the bore openings as a function of rotation of the valve element within the bore. A channel extends around the periphery of the valve element between opposite ends of the air aperture. A linkage projects from one end of the valve element for variably and controllably rotating the valve element within the bore between a fully open position in which the barrel aperture interconnects passages in the bore and a fully closed position in which air flow between the passages is routed through the channel around the periphery of the valve element.

12 Claims, 2 Drawing Sheets

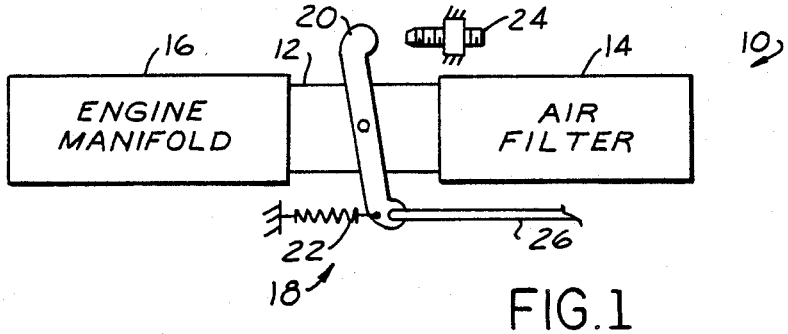
FIG.1
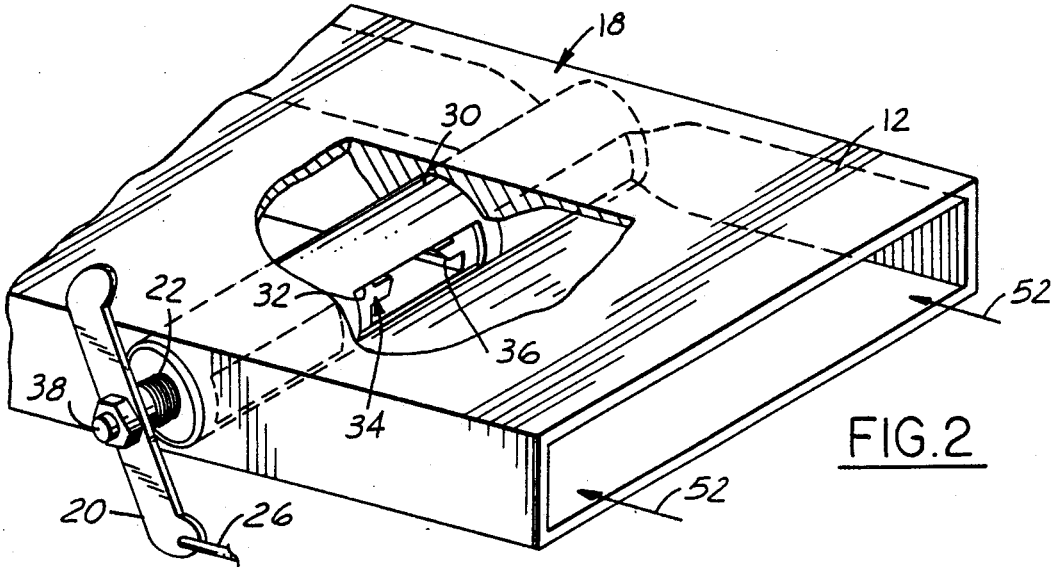
FIG.2
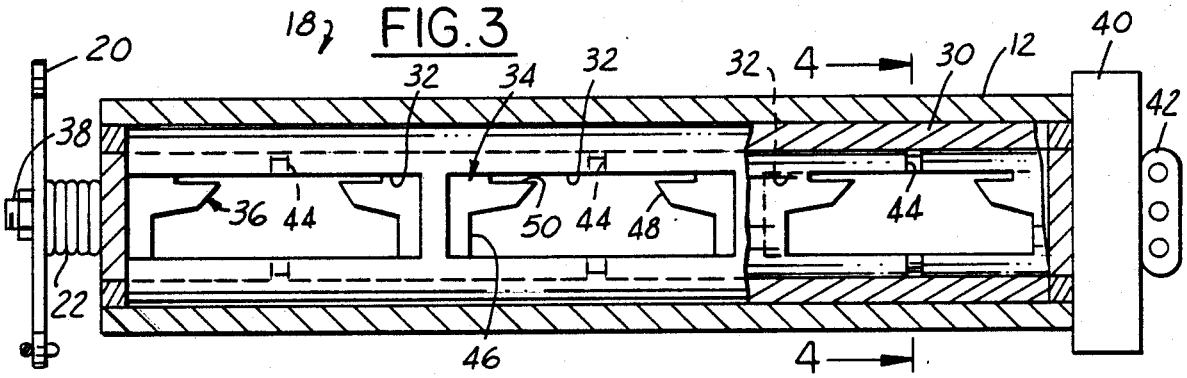
FIG.3
FIG.4
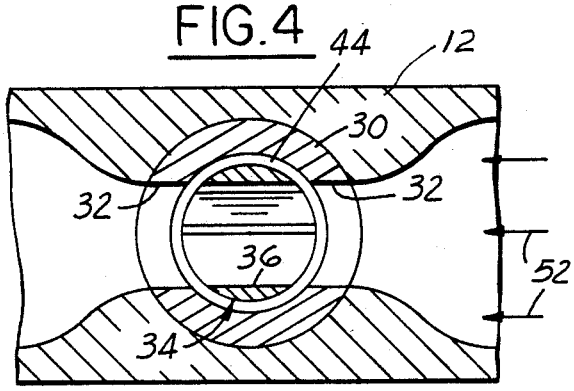
FIG.5
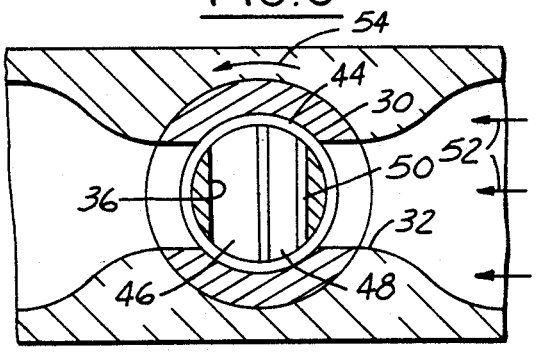

FIG.6
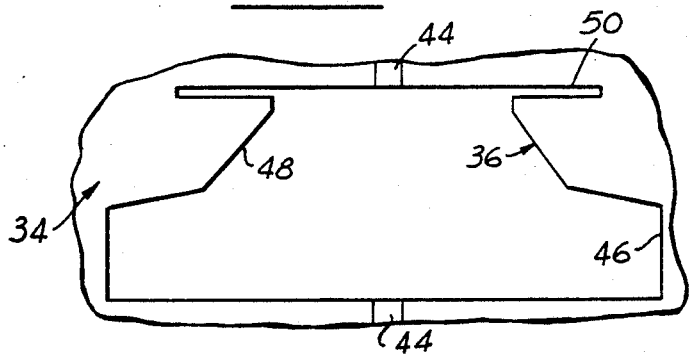
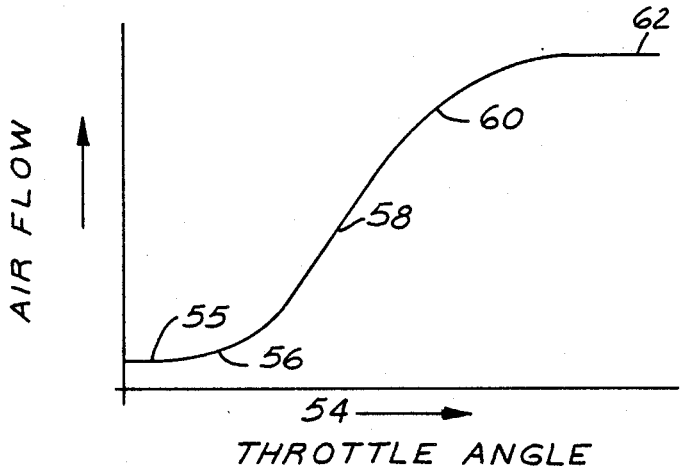
FIG.7

BARREL-TYPE THROTTLE VALVE FOR ENGINE AIR INTAKE

The present invention is directed to engine air intake arrangements, and more particularly to a throttle valve for selectively and variably controlling engine intake air flow.

Conventional blade-type engine air throttle valves that embody a simple one-element linkage have an air flow versus throttle angle characteristic which exhibits very steep or rapid change in air flow at low throttle angle. There is thus difficulty in adjusting and controlling idle speed, particularly in current engine designs which seeks to maximize performance while minimizing pollutants. In order to overcome this problem, the blade-type throttle valves on many current automobile engines include a multiple-element progressive linkage which seeks to linearize air flow characteristics and improve idle response. However, such progressive linkage arrangements are expensive and are too bulky for current low-profile engine design trends.

A general object of the present invention, therefore, is to provide a throttle valve arrangement for an engine air intake which is inexpensive to manufacture, which can be readily adjusted and repaired in the field, which can be readily modified to provide any predetermined characteristic of air flow as a function of throttle angle while maintaining commonality of overall design, which is specifically adapted to accommodate current low-profile engine design trends, and in which criticality of adjustment for idle air flow is substantially reduced or eliminated.

In essence, a throttle valve arrangement for an engine air intake in accordance with the present invention includes an engine intake air passage having a longitudinal direction of air flow. A cylindrical bore extends laterally across the passage and has diametrically opposed openings longitudinally aligned with the passage. A cylindrical valve barrel element is journalled for rotation within the bore and has an aperture extending diametrically therethrough for variably interconnecting the bore openings as a function of rotation of the valve element within the bore. A channel extends around the periphery of the valve element between opposite ends of the air aperture. A linkage projects from one end of the valve element for controlled variable rotation of the valve element about its axis within the bore between a fully open position in which the barrel aperture interconnects passages in the bore and a fully closed position in which air flow between the passages is routed only through the channel around the periphery of the valve element.

Most preferably, the aperture in the valve element is of uniform cross section diametrically through the valve element and is contoured or constructed to provide a predetermined characteristic of air flow through the aperture and through the bore openings as a function of rotation of the valve element within the bore. In a presently preferred embodiment of the invention, the openings in the bore are of rectangular cross section in the longitudinal direction of air flow, and the aperture in the valve element has a first substantially rectangular portion along one edge of the rectangular air passage in the fully open position, a second portion in which side walls of the aperture converge narrowingly, and a third laterally enlarged narrow portion. In a preferred application of the invention in low-profile engine designs, the air intake passage is of rectangular construction laterally of the longitudinal direction of air flow, the bore includes a plurality of pairs of openings positioned laterally of the longitudinal air flow direction, and the valve element includes a corresponding plurality of apertures positioned to interconnect respective pairs of the openings. A channel extends around the periphery of the valve element between opposed ends of each aperture pair. Most preferably, each idle air passage channel extends entirely around the perphery of the valve element and is laterally positioned in the middle of the corresponding aperture. The idle air channels are of rectangular cross section in the preferred embodiments of the invention. The apertures themselves may be of non-identical cross section to obtain a predefined air flow profile laterally across the air passage.

The invention, together with additional objects, features and advantages thereof, will be best understood from the following description, the appended claims and the accompanying drawings in which:

FIG. 1 is a functional block diagram of an engine air intake arrangement in accordance with the present invention;

FIG. 2 is a fragmentary partially sectioned perspective view of a barrel-type throttle valve in accordance with a presently preferred embodiment of the invention;

FIG. 3 is a lateral sectional view of the valve in FIG. 2;

FIG. 4 is a sectional view taken substantially along the line 4—4 in FIG. 3 and showing the valve in the fully open position;

FIG. 5 is a sectional view similar to that of FIG. 4 but showing the valve fully closed;

FIG. 6 is a fragmentary view on an enlarged scale of a valve element aperture in accordance with the presently preferred embodiment of the invention; and FIG. 7 is a graphic illustration of air flow versus throttle angle in accordance with the presently preferred embodiment of the invention illustrated in FIGS. 1—6.

FIG. 1 illustrates an air flow arrangement 10 for an internal combustion engine in which a passage or duct 12 connects an air filter or turbocharger 14 to an engine manifold 16. A throttle valve 18 within passage 12 includes a linkage 20 having one end biased by a spring 22 so as to urge the opposing end toward an adjustable stop 24. A connecting rod or cable 26 is connected to linkage 20 for rotating the same away from stop 24 and thereby increasing air flow from filter 14 to manifold 16.

As shown in FIG. 2, air passage 12 is of elongated rectangular construction laterally of the direction of air flow. Throttle valve 18 (FIGS. 2–6) comprises a tubular sleeve 30 having a central axis which extends laterally across passage 12 perpendicularly of the longitudinal air flow direction. Sleeve 30, which is fixedly mounted within passage 12, has a plurality of diametrically opposed pairs of rectangular openings 32 positioned in the air path. A cylindrical valve barrel element 34 is journalled within sleeve 30 for rotation about its axis. A plurality of apertures 36 in element 34 are each positioned in lateral registry with a corresponding pair of openings 32 in sleeve 30. Linkage 20 is mounted on a shaft 38 which extends from passage 12 coaxially with element 34, and spring 22 encircles shaft 38 and has opposed ends (not shown) respectively coupled to passage 12 and linkage 20. A rotary position transducer 40 is mounted on passage 12 at the opposing end of valve element 34 and has a connector 42 for feeding to engine control electronics (not shown) signals indicative of rotary poition of valve element 34 within sleeve 30.

A rectangular channel 44 extends entirely around the outer surface of valve element 34 centrally of each aperture 36. As best seen in FIGS. 3 and 6, each aperture 36 includes a generally rectangular base portion 46, a second portion 48 in which the aperture side walls converge or taper to a third portion 50 in the form of a thin elongated rectangular slot. Each passage 36 is of uniform construction entirely through element 34.

In the fully closed position of element 34 within sleeve 30, illustrated in FIG. 5, air flow from filter 14 to engine 16, indicated by the directional arrows 52, is essentially blocked but for a relatively small volume which passes around valve element 34 through channels 44. Thus, there is a minimum air flow to the engine in the fully closed or zero throttle angle position, as illustrated graphically in FIG. 7. As valve element 34 is rotated in the direction 54 in FIGS. 5 and 7 from the fully closed position of FIG. 5 toward from the fully open position of FIG. 4, either through adjustment of idle step 24 or through linkage rod 26, slotted portion 50 of aperture 36 first comes into registry with the inlet opening 32 in sleeve 30 and provides an initially increasing air flow as at 56 in FIG. 7. Thereafter, portions 48 and 46 register with inlet opening 32 as valve element 34 is rotated in the direction 54 to provide a substantially linear air flow characteristic 58 between the exponential characteristics 56,60 to the fully open position of FIG. 4, at which point air flow is at maximum level 62 in FIG. 7.

It will be appreciated that the contour of the air flow characteristic of FIG. 7 is initially a function of contour of channels 44, which provide minimum air flow at very low throttle angle, and then is a function of contour openings 36 at higher throttle angle. In accordance with an important advantage of the present invention, the contour of apertures 36 may be tailored to obtain any desired air flow characteristic. Indeed, where three laterally positioned sets of openings and apertures are employed, as in valve 18 of the drawings, apertures 36 may be of nonidentical contour so as to obtain a preselected air flow profile laterally across air flow passage 12. It will also be appreciated that, while provision of channels 44 in rotatable element 34 is preferred for reasons of economy and design flexibility, channels 44 could as well be provided in sleeve 30 without departing from the scope of the present invention in its broadest aspects.

The invention claimed is:

1. A throttle valve arrangement for an engine air intake comprising:

an engine air intake passage having a longitudinal direction, means forming a cylindrical bore extending laterally across said passage and having diametrically opposed openings longitudinally aligned with said passage, a cylindrical valve element journalled for rotation within said bore, said valve element having an aperture extending diametrically therethrough for interconnecting said openings in said bore, and a channel extending around the outer surface of said element between said openings, and means for rotating said valve lement within said bore between an open position in which said aperture interconnects said passages in said bore and a closed position in which air flow between said passages is routed through said channel.

2. The throttle valve arrangement set forth in claim 1 wherein said aperture in said valve element is of uniform cross section diametrically through said valve element.

3. The throttle valve arrangement set forth in claim 2 wherein said cross section is constructed to provide a predetermined characteristic of air flow through said aperture and openings is a function of rotation of said valve element within said bore.

4. The throttle valve arrangement set forth in claim 3 wherein said openings are of identical rectangular contour in said longitudinal direction.

5. The throttle valve arrangement set forth in claim 4 wherein said aperture has a first substantially rectangular portion, and a second portion in which side walls of said aperture converge narrowingly to taper said aperture to an enlarged third portion.

6. The throttle valve arrangement set forth in claim 5 wherein said means for rotating said valve element includes means for biasing said valve element to said closed position.

7. The throttle valve arrangement set forth in claim 3 wherein said passage is of rectangular construction laterally of said longitudinal direction, wherein said means forming said bore includes a plurality of pairs of said openings positioned laterally of said longitudinal direction, and wherein said valve element includes a plurality of said apertures positioned one between each said pairs of openings and a plurality of said channels extending around the periphery of said element between opposed ends of said apertures.

8. The throttle valve arrangement set forth in claim 7 wherein said openings and said apertures have nonidentical cross sections to air flow to obtain a predetermined air flow profile laterally across said passage.

9. The throttle valve arrangement set forth in claim 3 wherein said channel is found in said outer surface of said valve element.

10. The throttle valve arrangement set forth in claim 9 wherein said channel extends entirely around said valve element.

11. The throttle valve arrangement set forth in claim 10 wherein said channel is positioned laterally of said longitudinal direction centrally of said openings.

12. The throttle valve arrangement set forth in claim 11 in which said channel is of rectangular cross section.

* * * * *